US005927194A

United States Patent [19]

Jeschke

[11] Patent Number: 5,927,194

[45] **Date of Patent: *Jul. 27, 1999**

[54] SHEET-FED PRINTING PRESS FOR SYNCHRONIZING SHEET TRAVEL AND CONVEYOR BELT WITH PRINTING CYLINDERS

[75] Inventor: Willi Jeschke, Herrenalb, Germany

[73] Assignee: Heidelberger Druckmaschinen AG, Heidelberg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/842,026

[22] Filed: Apr. 23, 1997

Related U.S. Application Data

[63] Continuation-in-part of application No. 08/627,782, Apr. 1, 1996, abandoned.

[30] Foreign Application Priority Data

Mar. 30, 1995 [DE] Germany ..... 19511682

[51] Int. Cl.[6] ..... B41F 21/00; B41F 5/06

[52] U.S. Cl. ..... 101/183; 101/484; 101/485

[58] Field of Search ..... 101/183, 184, 101/177, 228, 227, 231, 232, 174, 136, 141, 484, 485, 137, 142–145, 216

[56] References Cited

U.S. PATENT DOCUMENTS

| | | | |
|---|---|---|---|
| 3,664,261 | 5/1972 | Dahlgren . | |
| 4,937,664 | 6/1990 | Chiku et al. | 358/75 |
| 5,383,392 | 1/1995 | Kowalewski | 101/183 |

FOREIGN PATENT DOCUMENTS

| | | |
|---|---|---|
| WO 82/00975 | of 0000 | European Pat. Off. . |
| 1 930 317 | 1/1970 | Germany . |
| 1 966 677 | 11/1973 | Germany . |
| 114 373 | 8/1975 | Germany . |
| 201 865 | 8/1983 | Germany . |
| 4 330 554 | 3/1995 | Germany . |
| 555 241 | 10/1974 | Switzerland . |
| 2 083 449 | 3/1982 | United Kingdom . |
| 82/00975 | 1/1982 | WIPO . |

*Primary Examiner*—J. Reed Fisher

*Attorney, Agent, or Firm*—Herbert L. Lerner; Laurence A. Greenberg

[57] ABSTRACT

Sheet-fed printing press with flat sheet guidance, having two endless conveyor belts for rectilinear, intervention-free movement of gripper carriages through printing units of the press, includes a device for adjusting the length of the conveyor belts, and a device for synchronizing the speeds of the conveyor belts and of the cylinders of the printing press, the length-adjusting device being made-ready for matching the belt lengths automatically to the cylinder circumference during operation, each of the conveyor belts having associated therewith its own drive and its own mechanism for synchronizing the speed of the respective conveyor belt with the respective cylinders independently of the other one of the conveyor belts, and method of synchronizing the sheet travel with the cylinders of the press.

16 Claims, 4 Drawing Sheets

ELECTRONIC COMPARISON DEVICE
CLCK.
HEATER CONT.
MAIN MOT. CTR.
MOT. CONTR.
P

SHEET-FED PRINTING PRESS FOR SYNCHRONIZING SHEET TRAVEL AND CONVEYOR BELT WITH PRINTING CYLINDERS

CROSS-REFERENCE TO RELATED APPLICATION

This application is a continuation-in-part of Ser. No. 08/627,782, filed Apr. 1, 1996 now abandoned.

BACKGROUND OF THE INVENTION

FIELD OF THE INVENTION

The invention relates to a sheet-fed printing press with flat sheet guidance, which has two endless conveyor belts for a rectilinear, intervention-free movement of gripper carriages through the printing units of the press, a device for adjusting the length of the conveyor belts, and a device for synchronizing the speeds of the conveyor belts and the cylinders of the printing press; and to a method for synchronizing sheet travel and a conveyor belt, respectively, with printing-unit cylinders of the press.

A sheet-fed printing press with flat sheet guidance has become known heretofore from German Patent 19 30 317. By flat sheet guidance there is meant that the sheets are passed in a single gripper lock in a horizontal plane from the feeder to the delivery, between the cylinders of a plurality of successive printing units. For in-register printing, sheet transport must be synchronized with the cylinders. Typical transport means with tooth elements, such as chains, however, have a disadvantage in that, during operation, they lengthen, and the tooth elements exhibit more-or-less major pitch errors and cause shocks on entry. Endless conveyor belts without interventions, such as the metal bands or belts proposed in the afore-cited German patent, each of which extends around a drive wheel and a deflection wheel and is kept to its length by suitable prestressing, appear to be more suitable in this respect.

Dispensing with mechanical force synchronization between the transport means and the cylinders creates new problems, however. For example, the drive wheels cannot be manufactured sufficiently precisely and wear out during operation, respectively. Moreover, they expand when warmed. For this reason if no other, synchronization errors occur over time in the gripper carriages secured to the conveyor belts.

To solve this problem, the East German Patent DD 201 865 has proposed that, for example, if the diameter of the drive wheels increases, either the distance from the deflection wheels be increased, so that the belt length remains an integral multiple of the circumference of a drive wheel, or that the rpm of the drive wheels be varied by a suitable variable gear transmission.

For many reasons, however, optimal synchronization cannot be obtained with the device according to the aforementioned East German patent, as is explained quite clearly hereinbelow.

SUMMARY OF THE INVENTION

It is accordingly an object of the invention to provide a sheet-fed printing press with a flat sheet guidance and a method for synchronizing sheet travel and a conveyor belt, respectively, with printing-unit cylinders of the press, with which synchronization of the sheet transport with the cylinders which perform the printing is accomplished both highly accurately and relatively simply.

With the foregoing and other objects in view, there is provided, in accordance with one aspect of the invention, a sheet-fed printing press with flat sheet guidance, having two endless conveyor belts for rectilinear, intervention-free movement of gripper carriages through printing units of the press, comprising a device for adjusting the length of the conveyor belts, and a device for synchronizing the speeds of the conveyor belts and of the cylinders of the printing press, the length-adjusting device being made-ready for matching the belt lengths automatically to the cylinder circumference during operation, each of the conveyor belts having associated therewith its own drive and its own mechanism for synchronizing the speed of the respective conveyor belt with the respective cylinders independently of the other one of the conveyor belts.

In accordance with another feature of the invention, the mechanism for synchronizing the conveyor belts with the cylinders, respectively includes a sensor for generating a signal when at least one of a sheet and a marking associated With the conveyor belt passes by the sensor, and a comparison device for comparing the sensor signal with clock signals of the cylinders.

In accordance with a further feature of the invention, the mechanism for synchronizing the conveyor belts with the cylinders, respectively includes another sensor for generating a signal when the at least one of the sheet and the marking associated with the conveyor belt passes by the other sensor, the other sensor being disposed at a location along the sheet transport path which is spaced a distance apart from the first-mentioned sensor.

In accordance with an added feature of the invention, the device for adjusting the length of the conveyor belts includes a control or regulator of the temperature of at least one of the conveyor belts, on the one hand, and the drive and deflection wheels thereof, on the other hand.

In accordance with another aspect of the invention, there is provided a method for synchronizing sheet travel with the cylinders in a printing press having two endless conveyor belts for rectilinear and intervention-free movement of gripper carriages through the printing units of the press, which comprises maintaining a matching of the lengths of the conveyor belts to the circumference of the cylinders during operation by driving each conveyor belt, respectively, independently of the respective other conveyor belt and synchronizing the respective conveyor belt with the cylinders independently of the respective other conveying belt.

In accordance with another mode, the method of the invention includes driving the cylinders with a constant speed so as to receive clock signals therefrom, the synchronizing of the conveyor belts with the cylinders being performed by comparing with the clock signals a respective group of signals obtained from the sheets, on the one hand, and from markings associated with the conveyor belts, on the other hand, respectively, as they travel by.

In accordance with a further mode, the method of the invention includes, for each conveyor belt, acquiring the signals from the sheets and from the markings, respectively, traveling by at least two locations spaced apart from one another along a sheet transport path, and adjusting the speed and the length of the conveyor belt in accordance with the signals from the sheets and the markings, respectively.

In accordance with an added mode, the method of the invention includes maintaining the length of the conveyor belts at a value which is precisely an integral multiple of the cylinder circumference.

In accordance with an additional mode, the method of the invention includes regulating the temperature of the conveyor belts and the temperature of the drive and deflection wheels thereof, respectively, so as to keep the belt lengths constant.

In accordance with a concomitant aspect of the invention, there is provided a method for synchronizing an endless conveyor belt for sheet guidance in a sheet-fed printing press with cylinders, which comprises acquiring, at least two locations spaced apart from one another along a sheet transport path, signals from the sheets and from markings associated with the conveyor belt, respectively, as they travel by, and adjusting both the speed and the length of the conveyor belt from the signals in accordance with the rotational speed and the circumference of the cylinders.

The invention is based, for one thing, on the recognition that an incalculable amount of slip always occurs between the surfaces of the drive wheels and the conveyor belts. However slight it may be, nevertheless, over time, it leads to errors in synchronization between the two conveyor belts or, in other words, to skewed positions of the gripper carriages. In heretofore known printing presses, these errors cannot be avoided with endless conveyor belts, because the drive wheels are firmly connected to a common drive shaft. Contrasting therewith, the invention calls for the two conveyor belt-s to be driven separately, so that the friction of each individual belt can be compensated for without difficulty.

The invention also avoids other grave disadvantages which have occurred in the prior art. As explained hereinabove, the possible changes in dimension of the transport means in German Patent 19 30 317 caused by varying operating conditions are ignored. While they are acknowledged in the East German Patent DD 201 865, they are nevertheless counteracted by unsuitable measures. In these measures, namely increasing the spacing of the drive and deflection wheels or varying the rotational speed if the diameter of the drive wheels increases, it is assumed that the belt length will increase and, to compensate therefor, the transport speed of the belt is effectively varied.

What is attained thereby is that a certain location on the conveyor belt, after one revolution, again coincides with an associated location on a cylinder. This type of register mark can be produced only for a single printing unit, however. For normal spacings of the printing units, at even very slight changes in length percentage wise, considerable differences in register occur beforehand at the other printing units.

Because, according to the East German Patent DD 201 865, the transport speed is varied without taking the cylinder rotation into account, if a belt lengthens, an exact synchronization is moreover no longer assured, which is once again a problem in practice.

By comparison, in accordance with the invention, the length of the two conveyor belts is kept adapted or matched to the cylinder circumference under all operating conditions and, in the normal case, is kept precisely to an integer multiple of the cylinder circumference. By this measure, in connection with regulating the drive of the conveyor belts, both register and synchronism are attained. Any dimensional changes of components of the printing press or the influence of friction need not be compensated foc individually but instead are balanced out in one operation.

In a preferred embodiment, the conveyor belts, respectively, travel around one drive wheel and one deflection wheel. The device for adjusting the length of the conveyor belts can then be based on the adjustable prestressing devices for the deflection wheels, heretofore known from the prior art, with which the deflection wheels can be adjusted towards and away from the drive wheels within the range of the mechanical prestressing of the belts.

The operating conditions which may be the cause for a change in belt length normally vary relatively slowly. The belt length can therefore be kept constant alternatively in an especially simple manner, namely by regulating the temperature of conveyor belts which are held resiliently taut. To that end, there is no need for the entire belt to be temperature-regulated; it suffices for the return run thereof, for example, or one of the drive or deflection wheels which are in thermal contact with the belt to be heated o-r cooled, so that a specific mean temperature is established which produces the desired belt length.

As a standard of comparison for the synchronization, any markings associated with the conveyor belts and scannable by a sensor can be used. Suitable possibilities for this are both the fed sheets themselves, for example, the leading edges thereof in the vicinity of the respective conveyor belts, and special markings formed on the gripper carriages. No further interventions need then to be made aside from coupling the gripper carriages to the conveyor belts. The gripper carriages need not even be coupled to the conveyor belts at exactly identical spacings. As for the gripper function, an error merely means that one carriage grips slightly more paper than the other or, in other words, the gripper edge varies. Nevertheless, a printing error does not occur if the signals which are furnished by a stationary sensor past which the markings travel during operation are compared in groups with constant clock signals from the printing cylinders, and are used for synchronization. A group of markings following one another in the transport direction in fact furnishes a periodic signal pattern, that is, a pattern which recurs each time the belt revolves, an error in synchronization being detectable extremely rapidly from the pattern and balanced out.

Neither the conveyor belts nor the drive and deflection wheels, the gripper carriages or the markings for synchronization have to be manufactured or positioned with any special accuracy, therefore, which is favorable from the standpoint of economy. Nevertheless, without a gripper lock or other mechanical means for synchronization with the cylinders, an extremely well synchronized sheet guidance is possible with the invention of the instant application. Because all of the errors being considered are balanced out during operation, the synchronization is preserved even under varying operating conditions or when there is wear of the transport means.

In one embodiment of the invention, the markings on each side of the printing press are scanned by two sensors which are disposed spaced apart behind one another. By means of the signals of these two sensors, the belt length can be measured in an especially simple manner and kept constant during the ongoing operation.

This latter method for synchronizing an endless conveyor belt with cylinders is useful not only in printing presses which have two conveyor belts for sheet guidance but also in printing presses with an arbitrary number of endless conveyor belts for sheet guidance. In that case, for the individual conveyor belt, signals of the sheets or of the markings associated with the conveyor belt traveling by are obtained at at least two locations spaced apart from one another along the sheet transport path and, from these signals, both the speed and the length of the conveyor belt are adjusted as a function of the rotational speed and the circumference of the cylinders.

The drive of the printing units presents no problems. It can be effected conventionally with a wheel block which preferably also drives a feed drum. However, there is no obstacle to separate single or individual drives for each printing unit, either.

Other features which are considered as characteristic for the invention are set forth in the appended claims.

Although the invention is illustrated and described herein as embodied in a sheet-fed printing press with flat sheet guidance and as a method for synchronizing sheet travel and a conveyor belt, respectively, with printing-unit cylinders of the press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figures 1A, 1B:
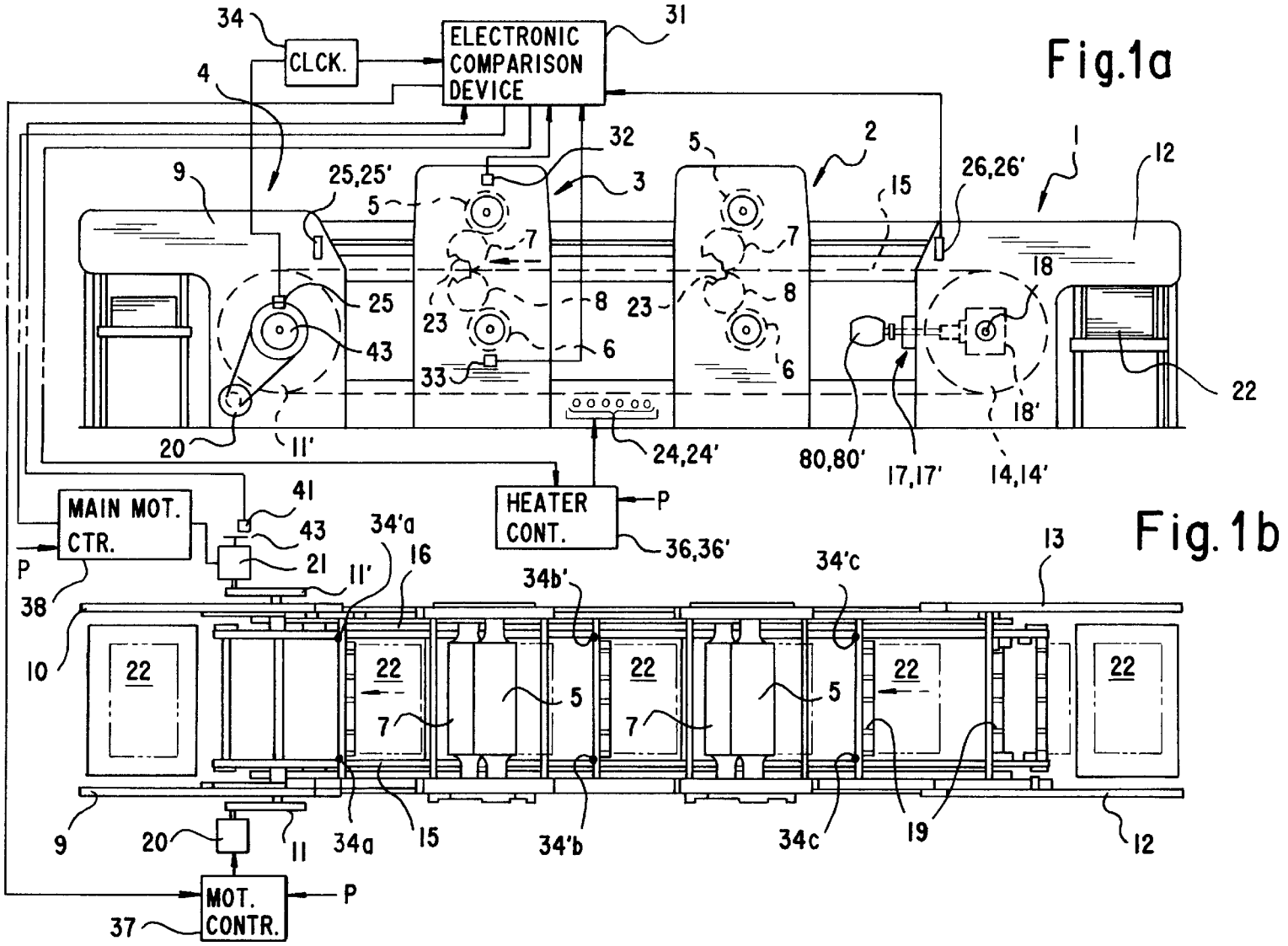
FIG. 1*a* is a diagrammatic side elevational view of a printing press.
FIG. 1*b* is a top plan view of FIG. 1.

Referring now to the figures of the drawing, there is shown therein a printing press which is a multicolor offset printing press with flat sheet guidance, including a feeder 1, two printing units 2 and 3, and a delivery 4. Each printing unit 2, 3, which operates in accordance with the rubber-against rubber principle, includes an upper and a lower plate cylinder 5 and 6, respectively, and an upper and a lower rubber blanket cylinder 7 and 8, respectively.

A respective drive wheel 11, 11' is supported rotatably on each of the two side walls 9 and 10 of the delivery 4. A respective deflection wheel 14, 14' is rotatably supported on each of the two sides walls 12 and 13 of the feeder 1. Traveling around the respective drive wheel 11, 11' and deflection wheel 14, 14' at each side of the press is a respective one of the conveyor belts 15 and 16. The two conveyor belts 15 and 16 are formed, by way of example, of steel or of plastic material with longitudinally extending steel fibers. Between the respective drive wheels 11, 11' and the respective deflection wheels 14, 14' the respective conveyor belts 15 and 16 run rectilinearly through the printing units 2 and 3 between the blanket cylinders 7 and 8 of each thereof. Each of the two conveyor belts 15 and 16 is kept taut by a respective tensioning and adjusting device 17, 17' with which each pivot shaft 18, 18' of the deflection wheels 14, 14' is adjustable separately in the longitudinal direction of the printing press. The drive wheels 11, 11' and the deflection wheels 14, 14' have relatively great masses to assure the smoothest, most uniformly possible travel of the conveyor belts 15 and 16.

Extending between the conveyor belts 15 and 16, perpendicularly to the longitudinal direction of the printing press, are a number of gripper carriages 19. In a manner not shown, the gripper carriages 19 are guided by rollers at the ends thereof in guide rails which extend parallel to the conveyor belts 15 and 16. The gripper carriages 19 are also coupled to the conveyor belts 15 and 16 at spaced intervals which are substantially equal to the circumference of the plate cylinders 5 and 6 and the like-sized blanket cylinders 7 and 8.

As is diagrammatically shown, each of the two drive wheels 11, 11' for the respective conveyor belts 15 and 16 is driven by its own drive motor 20 and 21, respectively. The printing units 2 and 3 and a non-illustrated feeding drum in the feeder 1 are connected to one another by likewise non-illustrated single revolution wheels, via which they are driven in common.

During the operation of the printing press, the feeding drum takes sheets 22 successively from a sheet pile and accelerates them. Next, the sheets 22 are engaged by the gripper carriages 19 and conveyed horizontally and rectilinearly in the direction of the associated arrow through the printing units 2 and 3 to the delivery 4. The blanket cylinders 7 and 8, respectively, are formed with a longitudinally extending recess or gap 23, which enables free passage of the gripper carriages 19 through the nip between the blanket cylinders 7 and 8.

The tensioning and adjusting devices 17, 17' are pre-adjusted so that the conveyor belts 15 and 16, which have been manufactured of a suitable length, are tautened or stretched to a length which initially is precisely equal to an integer multiple of the circumference of the plate cylinders 5 and 6 and the blanket cylinders 7 and 8. If operating conditions subsequently change and require a change in length of the conveyor belts 15 and 16, the respective position of the pivot shafts 18, 18' is then automatically adjusted by suitable control means so that the length of the conveyor belts 15 and 16 matches the multiple of an adapted or matched cylinder circumference. For a given printing press, the critical operating conditions, in terms of a change in length of the conveyor belts 15 and 16, are known, so that they can be monitored with suitable sensors, and the tensioning and adjusting devices 17, 17' can be adjusted in accordance with the desired belt length. Once constant operating conditions have been established, the belt length is also kept precisely constant.

Adjacent to the return run of the conveyor belts 15 and 16, a respective diagrammatically illustrated heater device 24, 24' is also provided, with which the length of each conveyor belt 15 and 16 can likewise be adjusted in a suitable manner. Although, in the exemplary embodiment, both the tensioning and adjusting devices 17, 17' and the heater devices 24, 24' are shown, for an especially simple construction or design it is also possible to provide a working embodiment with the heating devices 24, 24' alone. In that case, the deflection wheels 14, 14' are merely elastically suspended. Based upon the existing relationships between tension, temperature and length of the conveyor belts 15 and 16, the lengths thereof can then be regulated within a given range solely by regulating the temperature of the respective belt.

An electronic comparison device 31 has mark signals fed thereto from sensors 32, 33 disposed proximal to the respective plate cylinders 5 and 6. Successive mark signals indicate one revolution, for example, of the respective plate cylinders 5 and 6. A more detailed description of the operation of the electronic comparison device 31 is presented below. In a similar manner, markings 34, 34' on the respective ends of the gripper carriages 19 move past respective two sensors 25, 25' fixed to the printing press, each located in the vicinity of a respective conveyor belt 15 and 16. The sensors 25, 25' generate signals which are likewise fed to the comparison device 31.

The clock signals of the plate cylinders 5 and 6 and the signals of the sensors 25 are compared with one another in the comparison device 31 in order to synchronize the travel of each conveyor belt 15 and 16 individually, both timewise and spatially,i.e., chronologically and three-dimensionally, with the plate cylinders 5 and 6. Because, for reasons of economy, the positions of the gripper carriages 19 are permitted to deviate from the respective ideal positions by a few tenths of a millimeter in each case, the signals from a number x of successive gripper carriages 19 are each compared with the clock signals. One gripper carriage 19 leads by a specific amount, while the other lags behind. Given synchronized phases, the amount of leading and trailing produces an invariable data pattern for the x gripper carriages. If one belt revolution is not equal to x cylinder revolutions, then the data pattern shifts to one side, and the regulation is performed by having the drive motor 20 or 21 run faster or slower, until an in-phase situation is re-established.

In a further construction of the sheet-fed printing press, second sensors 26, 26' are mounted in the vicinity of respective conveyor belts 15, 16, at an adequate distance from the respective sensors 25, 25'. By a comparison of the signals of the two sensors 25, 25' and 26, 26' of respective conveyor belts 15 and 16, the actual belt length of each belt is attained during operation, so that other monitoring of operating conditions which, if changing may lead to a change in length of the conveyor belts, becomes unnecessary.

The belt length is then kept adapted or matched by means of the heater devices 24, 24' and/or the tensioning and adjusting devices 17, 17' respectively, to the cylinder circumference, as described hereinabove. The surface speeds of the conveyor belt and the cylinders are then precisely equal and, because of the constant belt length, not only the plate cylinder 5 but also the plate cylinder 6 and, if necessary or desirable, the cylinders of other printing units are in phase, or in other words in "register" with the conveyor belt.

The signals of the second sensors 26, 26' also like the signals of the sensors 25, 25' are evaluated in the form of data patterns, which are obtained from a group of successive gripper carriages 19. As a result, despite a given signal deviation, optimal information is obtained regarding the phase position, the belt speed, and the belt length. The evaluation of the data patterns is performed in real time, always for the signals of the last gripper carriages, with an immediate regulating intervention.

Under some circumstances, it may be expedient for a correction of the belt length to be included in the regulation. For example, if paper which stretches markedly during the printing process is to be printed, the belt length could then be lengthened in a purposeful manner, to assure a constant withdrawal from the printing gap. To optimize sheet withdrawal from the blanket cylinder, a somewhat lower belt speed or shorter belt length might also be desirable. This operating state can also be brought about within certain limits. However, in that case, attention must always be given to the phase positions of the printing units, and they should be adapted or matched, appropriately.

As already mentioned, it is an important characteristic of the invention that each conveyor belt 15, 16 be driven and synchronized with the cylinders independently of the other conveyor belt 16, 15, respectively. It can therefore be expedient, in the event of a failure of a regulating system or of a drive motor 20, 21, to provide emergency couplings. These may, for example, be formed of a conditional mechanical forced synchronization of the drive wheels 11, 11' each drive wheel being coupled with play to the machine drive via an infinitely graduated or continuous gear, and this coupling is automatically kept within range of the play in regular operation by means of the infinitely graduated gear, in order not to impair the ongoing synchronization. If a drive fails, the suitably adjusted play then prevents the gripper carriages from leaving the region of the recesses in the cylinders. The conditional forced synchronization can also be helpful at the start-up of the cylinders.

Figure 2:
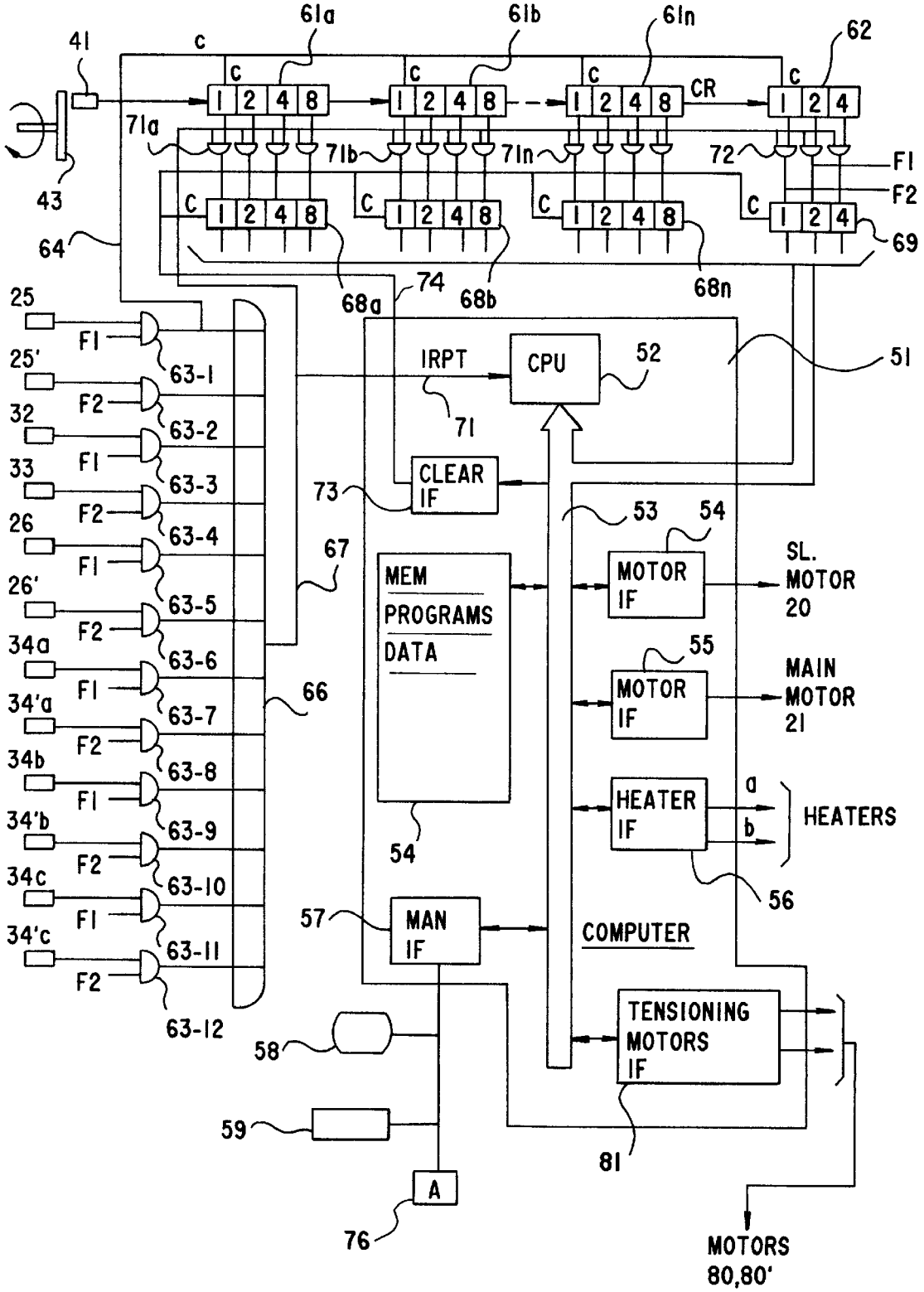
FIG. 2 is a block diagram of the control system for the printing press.

Details of the electronic comparison device 31 is shown in FIG. 2, wherein it is constructed around a computer 51, having a central processing unit (CPU) 52 connected via multi-bit computer bus 53 to a memory 54 having memory space arranged to store control programs and data, as required to operate and control the printing press of FIGS. 1 and 2. The computer performs its operation in accordance with the flow chart shown in FIG. 4. The computer also includes two motor interfaces 55, 54 respectively controlling main motor 21 and a slave motor 20, slaved to main motor 21 via respective motor controls 38 and 37 (FIG. 2), as described in more detail below.

The computer 51 also includes a heater interface 56 having two outputs a and b respectively controlling heater controls 36, 36', which in turn drive heaters 24, 24'.

The computer also includes a manual interface 57 which operates a display device 58 and a control console 59, both of conventional construction. The manual interface allows a machine operator to monitor the operation of the printing machine and to manually insert and change data and change the operation of the machine.

The circuit of FIG. 2 is essentially a computer operated version of the electronic comparison device 31 shown in FIG. 1*a*.

At the left hand side of FIG. 2 the various sensors 25, 25', 32, 33, 26, 26', 34*a*, 34'*a*, 34*b*, 34'*b*, 34*c*, and 34'*c* described above are shown.

The circuit of FIG. 2 operates as follows:

One of the belt drive wheels 11' is driven by a main motor 21 (FIG. 1*b*), the speed and rotational angle of the wheel 11' is controlled by a main motor control 38. The main motor 24 has an angle transmitter disk 43 mounted on its shaft. The angle transmitter disk is of conventional construction and contains on one or more circular tracks a plurality of closely spaced incremental marks, which are scanned by one or more angle increment sensors 41, typical in the form of an optical sensor arrangement. As the motor 21 turns, the sensor transmitter 41 transmits a series of pulses representing the rotation of the disk 43 and the motor 21. The pulses are counted in a series of pulse counters 61*a*, 61*b*, . . . 61*n*, e.g. in the form of blocks of binary counters in well known manner, followed by a phase counter 62 which counts phases F1 and F2. The binary counters 61*a*, 61*b*, . . . 61*c* are for practical purposes arranged as four bit counters, that each counts in binary manner from 0 to 15 in conventional hexa-decimal notation, for which most modern computers are arranged. As the printing machine goes through a complete printing cycle, i.e. from a first sheet 22 entering the machine from right to left until it is stacked on the sheet stack 22, for each position of the sheet, the counter 61*a*–61*n* advances from a starting count 0,0, . . . 0 to a final count x,x, . . . x in a first phase 0, at which time the counter is reset or cleared on clear lead C, after which a second sheet is printed again through counts 0, 0, 0 . . . 0 to x, x, . . . x, in the second phase F2. As the machine goes trough a complete printing cycle for a sheet, the various sensors 25, 25' 32, 33, etc., shown in the column at the left hand side of circuit FIG. 2 each generates a signal. The circuit operates to assign a respective count in a respective phase from the binary counter 61*a* . . . 61*b* and phase counter 62 to each sensor signal. The assigned count for each sensor is stored by the computer 51 in its data memory in a respective memory location for that sensor. After a sheet has gone through a complete printing cycle for the first and second phase every sensor signal has been stored with its respective binary count and phase in the computer memory. From the respective counts the computer is programmed to determine the exact linear travel of the belt in e.g. 1/1000 of an inch per increment of the angle transmitter 41, and if the two belts 15 and 16 have the proper lengths, if the blanket cylinders 5 are in precise alignment and if the length of the conveyor belts are matched precisely to the circumferences of the blanket cylinders as integer multiples of their circumferences.

Since the signal sensors are divided into a left and a right side group, and the corresponding left and right sensor signals should ideally occur simultaneously, a complete scan is performed in the two phases F1, and F2. In first phase F1 all left hand sensors 25, 32, 26, 34*a*, 34*b*, and 34*c*, etc. are scanned and the right hand sensors 25', 33, 26', 34'*a*, 34'*b*, and 34'*c* are scanned in phase F2. The binary counter 62 in FIG. 2 operates to toggle between phases F1 and F2, as described below in the detailed description of the operation of the control circuit of FIG. 2.

The system shown in FIG. 2 operates on the principle that sensor signal 25 resets all counting circuits in phase F1, and therefore has a count of 0.0 . . . 0. All other sensor signals are measured from count 0.0 . . . 0, through phase 1 and phase 2, i.e. F1, F2.

Referring now to FIG. 2, a first sensor signal appears at sensor 25 and is gated through AND-gate 63-1 in phase F1. The output 64 from AND-gate 63-1 resets all binary counters 61*a*, 61*b*–61*n*, and 62 at their clear input C. At the same time the output signal of AND-gate 63-1 goes through OR-gate 66 whose output 67 clears buffer memory cells 68*a*, 68*b*, - - - 68*n* and 69 at their clear inputs C. Output 67 also initiates an interrupt cycle IRPT of the CPU 52. The interrupt cycle prepares the CPU 52 to receive the next sensor signal, namely from sensor 26 in phase F1 as the mark on belt goes around and arrives at sensor 26, which generates a sensor signal that goes through AND-gate 63-5 in phase F1. At this time the binary counter has advanced to a certain count determined by the number of pulses received from sensor 41 coupled to the angle transmitter 43, described above. This count now placed in binary counters 61*a*, 61*b*, . . . 61*n*, and 62 representing the position of the mark on the belt is transferred via transfer gates 71*a*, 71*b* . . . 71*n*, and 72 to buffer memory cells 68*a*, 68*b*, . . . 68*n*, and 69, wherein the count at the moment of appearance of sensor signal 26 is temporarily stored. At the same time an interrupt cycle is again initiated on interrupt lead IRPT. In this interrupt cycle the computer operates to read the count present in the buffer stores 68*a*, 68*b*, . . . 68*n*, and 69, the outputs of which are connected to the computer bus 53. The computer 51 is programmed to store the count in a memory location assigned for storing this count from sensor 26. Next the computer generates via clear interface (IF) circuit 73 a clear signal on lead 74, which clears all buffer-stores 68*a*, 68*b*, . . . 68*n*, and 69, and awaits the next sensor signal. According to FIG. 1*a* the next sensor signal will issue from sensor 32 in phase 1, which reads a mark on blanket cylinder 5. Sensor signal 32 is again transferred, as described above for sensor signal 26, with its corresponding count from counter 61*a*, 61*b*, . . . 61*n*, and 62 in an assigned memory cell in computer memory 54. After the last sensor signal in phase 1, namely sensor signal 34*a* has been read and stored with its respective count, phase counter 62 switches to phase F2 on a carry signal CR from counter CN. During phase F2 all sensors on the opposite side of the machine are, namely sensors 25' in phase F2, via AND-gate 63.2, sensor 33 of the lower blanket cylinder 6 in printing unit 3 and so forth, on this side of the machine are being read and their respective counts stored in the computer memory 54. Next the whole cycle as described above is repeated again and again, with the counters 61*a*, 61*b*, . . . 61*n*, and 62 being reset by the sensor signal from sensor 25 in phase F1.

As a result the computer is at all times monitoring and recording the exact setting of all sensors. In addition, for each sensor, the computer has stored in a memory cell for that sensor a nominal position for the sensor, expressed as a nominal count for that sensor. According to the programming of the computer, any difference between an actual position count for a sensor and its nominal count, if it exceeds a given preset tolerance tn, can be used to summon the attention of the machine operator by means of an annunciator A, 76, and the operator can from the display 58 and console 59 determine if remedial action is required.

For example, if sensors 25, 25' indicate a shift in position of the two belts 15 and 16, corrective action can be taken by advancing or retarding the rotary angle of the slave motor 20 in regard to main motor 21. To that end motor interface 54 in the computer will issue a signal to slave motor control 37 to advance or retard that motor a certain angular amount as determined by the computer. Such controls of motors are well known from the art of motor controls, as used e.g. in servo motors. Motors well suited for this purpose are known as multiphase motors or stepper motors.

Another problem may arise if the belts 15, 16 are stretched or shortened due to changes in e.g. temperature, type of printing material, ink, and so forth. The length of the belts can be determined precisely by the computer as the difference in position count between sensors 25, 26. It is readily seen that for a given machine geometry, each increment in the position count corresponds to a corresponding proportioned length increment on the belt. As described above the length of the belt can be increased by varying the temperature by means of the heater 24, 24'. The heater is controlled by a respective heater control 36, 36'.

Figure 3:
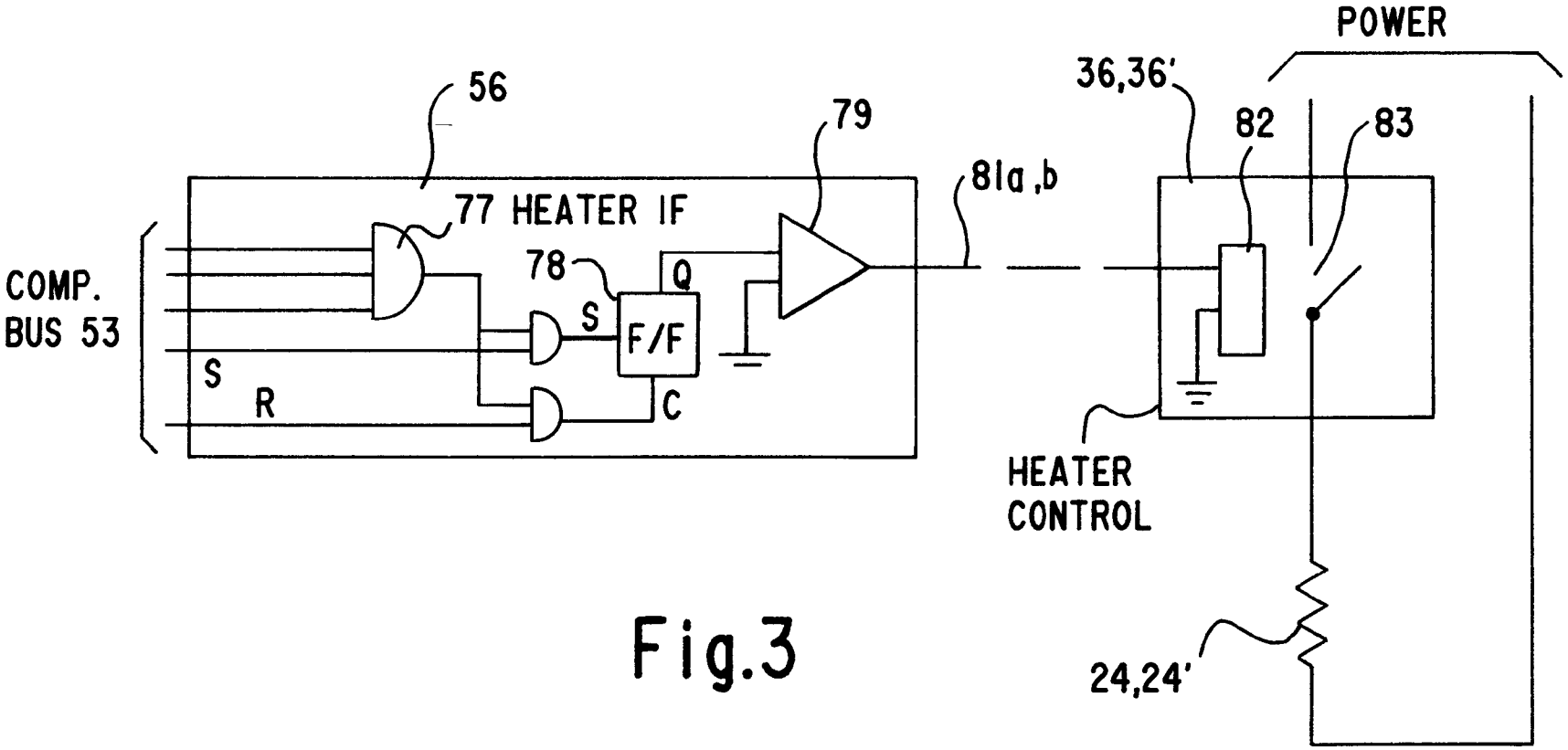
FIG. 3 is a block diagram of a heater control arrangement for the band heater.

FIG. 3 shows a heater interface 56 receiving the computer bus 53 addressing a heater address gate 77, which enables a flip-flop 18 which can be cycled on and off, to be set and reset at leads S, R respectively. The flip-flop output Q drives an amplifier 79, which via power control lead 81*a*, or b cycles a power relay 82 with a contact 83, which cycles the heater 24, 24' on and off to set the correct heating temperature required to set the length of a respective belt 15, 16. The heating temperature may be obtained from a table correlating the belt length with the temperature, stored in memory 54, or by step-wise increasing the belt temperature until the proper length is attained.

Figure 4:
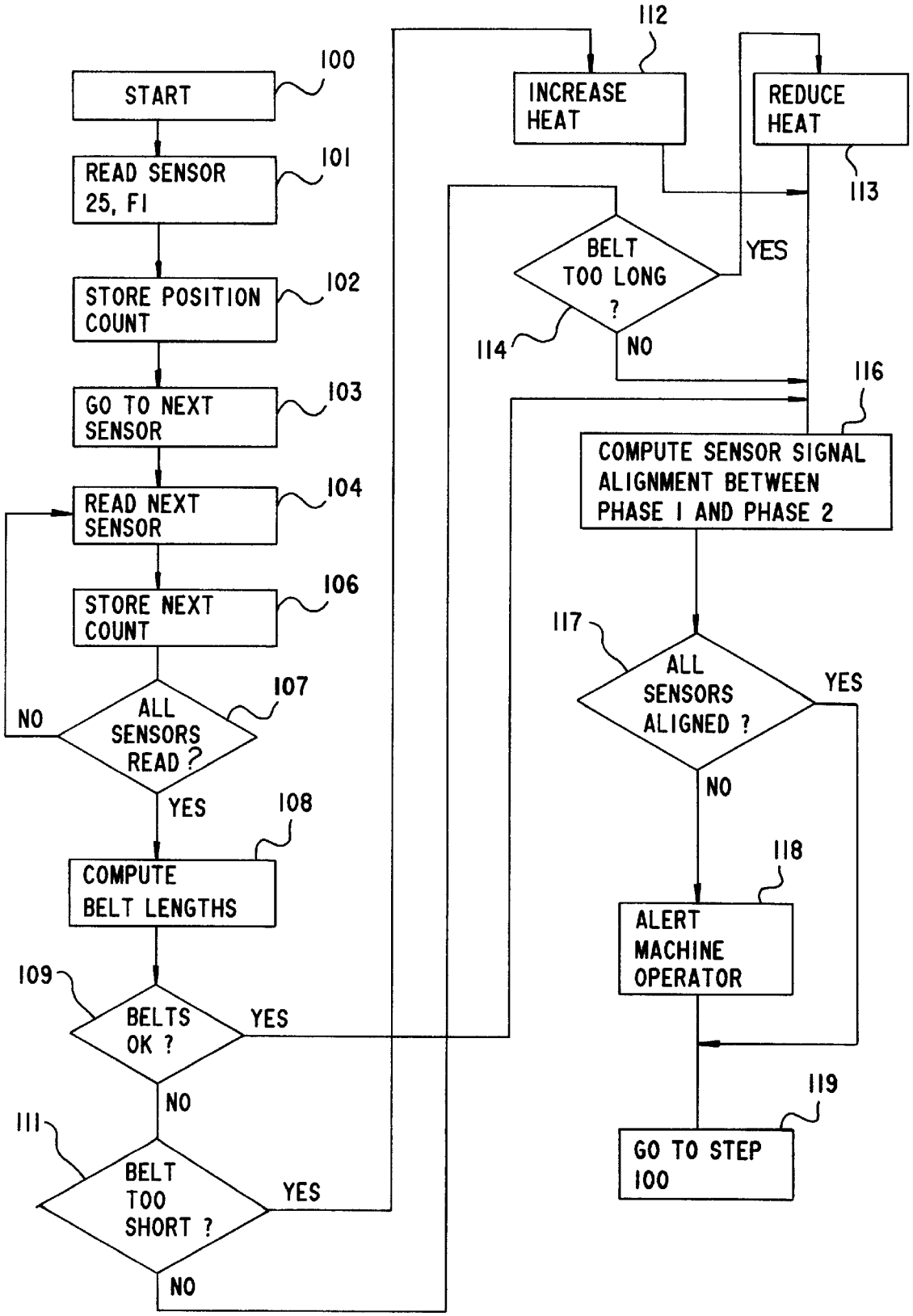
FIG. 4 is a flow chart showing the steps of the system control.

FIG. 4 is a flowchart showing the major steps in operating the invention. After start 100 the first sensor 25 is read in phase 1, and the corresponding position count is stored in step 102, followed by reading of the next sensor in steps 103, and 104, and storing the next count in step 106. Step 107 checks if all sensors are read, if not the next sensor is read again in step 104, if affirmative the belt lengths are computed by the computer by subtracting one position number from the other in step 108. If the belt lengths are not ok in step 109, and found to be too short in step 111, heat is increased in step 112. If the belts are too long in step 114, heat is reduced in step 113. If the belts are ok in step 109, alignment between phase 1 and phase 2 sensor signals is computed in step 116. If all sensors are aligned in step 117, the process is repeated in step 119. If all sensors are not aligned, e.g. after a certain number of trips through steps 101–119 the machine operator is alerted in step 118.

As mentioned above, instead of heating, the belt may be adjusted by adjusting the belt tension by means of deflection wheels 14, 14'. To this end, the pivot shaft 18, 18' may be adjusted by tensioning motors 80,80' controlled by the computer 51 in a manner similar to the control of the heaters 36, 36'. The tensioning motors 80, 80' are controlled by a tensioning motor interface 81, driven by the computer 51 via computer bus 53.

I claim:

1. Sheet-fed printing press with sheet guidance and including printing units having cylinders each with a cylinder circumference, comprising at least two endless conveyor belts for rectilinear movement of gripper carriages through the printing units of the press, including adjusting means for adjusting a length of the conveyor belts, markings on the conveyor belts, and reading means for reading the markings, a device for synchronizing speeds of the conveyor belts and of the cylinders of the printing press coupled to said adjusting means, said length-adjusting means being made-ready for matching belt lengths automatically to the cylinder circumference during operation, each of the conveyor belts having associated therewith a respective drive and deflection wheel and a respective mechanism for synchronizing the speed of a respective conveyor belt with a respective cylinders' angular velocity and circumference independently of the other one of the conveyor belt, wherein said means for adjusting the length of the conveyor belts includes a control or regulator of the temperature of at least one of the conveyor belts, on the one hand, and the respective drive on the other hand.

2. Sheet-fed printing press according to claim 1, wherein said mechanism for synchronizing the conveyor belts with the cylinders, respectively includes a sensor connected with said reading means for generating a signal when at least one of a sheet and a marking associated with the conveyor belt passes by said sensor, and a comparison device for comparing the sensor signal with clock signals of the cylinders.

3. Sheet-fed printing press according to claim 2, wherein said mechanism for synchronizing the conveyor belts with the cylinders, respectively includes another sensor for generating a signal when the at least one of the sheet and the marking associated with the conveyor belt passes by said other sensor, said other sensor being disposed at a location along the sheet transport path which is spaced a distance apart from the first-mentioned sensor.

4. Method for synchronizing sheet travel with cylinders in a printing press having two endless conveyor belts for rectilinear and intervention-free movement of gripper carriages through printing units of the press, which comprises:

maintaining a matching of lengths of the conveyor belts to a circumference of the cylinders during operation by driving each conveyor belt, respectively, independently of the respective other conveyor belt and synchronizing the respective conveyor belt with the cylinders independently of the respective other conveying belt; and regulating a temperature of the conveyor belts so as to assist in keeping the belt lengths constant.

5. Method according to claim 4, which includes driving the cylinders with a constant speed so as to receive clock signals therefrom, the synchronizing of the conveyor belts with the cylinders being performed by comparing with the clock signals a respective group of signals obtained from the sheets, on the one hand, and from markings associated with the conveyor belts, on the other hand, respectively, as they travel by.

6. Method according to claim 5, which includes acquiring, for each conveyor belt, the signals from the sheets and from the markings, respectively, traveling by at least two locations spaced apart from one another along a sheet transport path, and adjusting the speed and the length of the conveyor belt in accordance with the signals from the sheets and the markings, respectively.

7. Method according to claim 4, which includes maintaining the length of the conveyor belts at a value which is precisely an integral multiple of the cylinder circumference.

8. Method according to claim 4, which includes regulating a temperature of drive and deflection wheels, respectively, so as to keep the belt lengths constant.

9. Method for synchronizing an endless conveyor belt for sheet transport in a sheet printing machine, the sheet printing machine having cylinders each with a circumference and at least two marks disposed on the conveyor belt, the method comprising the steps of:

generating signals with the aid of a sensor sensing a passage of the at least two marks, determining on the basis of the signals a velocity of the conveyor belt, determining on the basis of the signals a length of the conveyor belt, and supplying heat to the conveyor belt by at least one of direct or indirect heat transmission from a heating device for assisting in controlling the length of the conveyor belt.

10. The method according to claim 9, further comprising:

obtaining further signals with the aid of another sensor sensing the passage of sheets on the conveyor belt;

synchronizing the conveyor belt with the cylinders by means of comparing the further signals caused by the passing sheets with the signals obtained from the at least two marks on the conveyor belt.

11. The method according to claim 10, further comprising determining for the conveyor belt at least two signals obtained from the at least two marks, and adjusting on the basis of the at least two signals both the velocity and the length of the conveyor belt.

12. The method according to claim 11, comprising the step of:

adjusting the length of the conveyor belt to be equal to an integer multiple of the circumference of one of the cylinders.

13. The method according to claim 12, comprising the step of:

adjusting the length of the conveyor belt and a conveyor belt drive element by controlling a temperature of the conveyor belt and the conveyor belt drive element.

14. The method according to claim 9, further including comparing with a comparison device the signals with timing signals from one of the cylinders.

15. The method according to claim 9, further including another sensor for generating signals upon sensing passage of at least one sheet disposed on the conveyor belt and the at least two marks, and positioning the other sensor at a given distance from the sensor.

16. The method according to claim 9, further including an adjusting device for adjusting the length of the conveyor belt.

* * * * *